US009234393B2

(12) United States Patent
Edwards et al.

(10) Patent No.: US 9,234,393 B2
(45) Date of Patent: Jan. 12, 2016

(54) BORE SELECTOR

(75) Inventors: Jonathan Paul Edwards, West Perth (AU); Alexander Jeffrey Burns, Willetton (AU)

(73) Assignee: HELIX WELL OPS (U.K.) LIMITED, Aberdeen (GB)

( * ) Notice: Subject to any disclaimer, the term of this patent is extended or adjusted under 35 U.S.C. 154(b) by 1428 days.

(21) Appl. No.: 12/162,055

(22) PCT Filed: Jan. 24, 2007

(86) PCT No.: PCT/AU2007/000064

§ 371 (c)(1), (2), (4) Date: Dec. 1, 2008

(87) PCT Pub. No.: WO2007/085046

PCT Pub. Date: Aug. 2, 2007

(65) Prior Publication Data

US 2009/0223671 A1 Sep. 10, 2009

(30) Foreign Application Priority Data

Jan. 24, 2006 (AU) ..... 2006900344
Jul. 24, 2006 (AU) ..... 2006903966

(51) Int. Cl.

| | |
|---|---|
| ***E21B 33/038*** | (2006.01) |
| ***E21B 23/00*** | (2006.01) |
| ***E21B 43/013*** | (2006.01) |
| ***E21B 17/01*** | (2006.01) |
| ***E21B 33/076*** | (2006.01) |
| ***E21B 17/18*** | (2006.01) |

(52) U.S. Cl.

CPC ..... *E21B 17/01* (2013.01); *E21B 17/18* (2013.01); *E21B 33/038* (2013.01); *E21B 33/076* (2013.01)

(58) Field of Classification Search

USPC ..... 166/339, 344, 381, 382, 345, 348

See application file for complete search history.

(56) References Cited

U.S. PATENT DOCUMENTS 3,252,515 A * 5/1966 Donaldson et al. ..... 166/114
3,256,937 A * 6/1966 Haeber et al. ..... 166/344
3,554,281 A * 1/1971 Ecuer ..... 166/155

(Continued)

FOREIGN PATENT DOCUMENTS

EP 611085 8/1994
GB 2258675 A * 2/1993 ..... E21B 33/068

(Continued)

OTHER PUBLICATIONS

PCT/AU2007/000064, Jan. 24, 2007, International Search Report.

(Continued)

*Primary Examiner* — James G Sayre

(74) *Attorney, Agent, or Firm* — Alston & Bird LLP

(57) ABSTRACT

An apparatus (10) for coupling a monobore riser or lubricator system (11) to a dual bore (12) subsea well, the apparatus has a rotatable bore selector (30) within a housing (20). The bore selector has at least one conduit (35) to provide through bore communication between the riser bore or lubricator (11) and selectively at least one or other of main (60) and annulus (70) bores in the dual bore (12) well. The bore selector in a first position connects the conduit between the riser or lubricator bore and the main bore, and in a second position connects the conduit between the riser or lubricator bore and the annulus bore. The rotatable selector can be offset or set at a tilt angle of up to ±5° with respect to the length of the apparatus.

18 Claims, 3 Drawing Sheets

(56) References Cited

U.S. PATENT DOCUMENTS

| | | | | |
|---|---|---|---|---|
| 3,741,294 | A * | 6/1973 | Morrill | 166/367 |
| 4,133,418 | A * | 1/1979 | Van Bilderbeek | 193/23 |
| 4,508,166 | A * | 4/1985 | Becker et al. | 166/117.5 |
| 4,646,839 | A * | 3/1987 | Rickey | 166/335 |
| 4,770,247 | A | 9/1988 | Wilkins | |
| 5,129,459 | A | 7/1992 | Breese | |
| 5,377,762 | A * | 1/1995 | Turner | 166/341 |
| 5,732,773 | A * | 3/1998 | Parks et al. | 166/117.5 |
| 5,941,310 | A * | 8/1999 | Cunningham et al. | 166/345 |
| 6,170,578 | B1 * | 1/2001 | Edwards et al. | 166/339 |
| 6,408,947 | B1 * | 6/2002 | Cunningham et al. | 166/339 |
| 6,547,008 | B1 * | 4/2003 | Hopper et al. | 166/348 |
| 6,561,276 | B2 | 5/2003 | Hamilton | |
| 6,725,936 | B2 * | 4/2004 | Hopper | 166/366 |
| 7,114,571 | B2 * | 10/2006 | Gatherar et al. | 166/367 |
| 7,654,329 | B2 * | 2/2010 | Lindland et al. | 166/368 |
| 2005/0217844 | A1 * | 10/2005 | Edwards et al. | 166/85.1 |

FOREIGN PATENT DOCUMENTS

| | | | |
|---|---|---|---|
| GB | 2326433 | 12/1998 | |
| GB | 2362400 A | 11/2001 | |
| WO | WO 9737101 A1 * | 10/1997 | E21B 23/12 |

OTHER PUBLICATIONS

European Patent Office, Extended European Search Report for Application No. 07701399.3, Jul. 15, 2014, 6 pages, Germany.

* cited by examiner

BORE SELECTOR

FIELD OF THE INVENTION

The present invention relates to coupling a subsea monobore riser or lubricator to a dual bore subsea well in particular the invention related to an apparatus to provide selective communication from the subsea monobore riser or lubricator to the bores in the dual bore subsea well.

BACKGROUND OF THE INVENTION

In the field of subsea hydrocarbon extraction, subsea wells often have two bores. This often consists of a main mainbore, often used for main, and an annulus which may also be used for gas injection. When intervening in a subsea well to undertake maintenance or abandonment work, it is often necessary to access both the main bore and the annulus. Often, previously when intervening in subsea wells using a subsea monobore riser or lubricator system access to only one of the bores is possible at a time.

When a subsea monobore riser or lubricator system is used, once access is gained to one of the bores and the work required on that bore is completed the monobore or lubricator system is recovered to the deck of the vessel. Should access also be required to the second bore a different adapter is fitted and tested, and the monobore riser or lubricator system is again lowered to the subsea well and the tools are inserted into the second bore to undertake the necessary work. The retrieval and deployment of a subsea riser or lubricator system is not a trivial exercise and each time the operation is performed the possibility of complications occurs.

The removal and replacement of the monobore riser or lubricator system including the various pressure testing steps is time consuming and therefore expensive. It is desired to find an alternative way of accessing both bores when using a subsea monobore riser or lubricator system.

One way of gaining access to both bores without the need to redeploy the riser or lubricator system is the use of a dual bore riser or lubricator system. There is a significant cost associated with the use of a dual bore riser system including capital and operating cost as a much larger vessel is required.

The reference to any prior art in this specification is not, and should not be taken as, an acknowledgement or any form of admission that the prior art forms part of the common general knowledge in Australia.

SUMMARY OF THE INVENTION

In order to alleviate one or more problems of the prior art, the present invention provides in one aspect an apparatus for coupling a monobore riser or lubricator system to a dual bore subsea well wherein said apparatus is adapted to allow communication between the monobore riser or lubricator system and either of the bores in the dual bore subsea well wherein the apparatus includes a bore selector housing and a rotatable bore selector with an actuating means.

A further aspect provides an apparatus for coupling a monobore riser or lubricator system to a dual bore subsea well, wherein said apparatus includes a rotatable bore selector within a housing, and a means to actuate the bore selector, wherein the bore selector is rotatably actuatable to provide throughbore fluid communication through a conduit selectively connecting the monobore riser or lubricator system and either of the bores in the dual bore subsea well.

When the bore selector is in a first position, communication is established between the subsea monobore riser or lubricator and the main bore. When the bore selector is a second position communication is established between the monobore riser or lubricator and the annulus of the dual bore well.

Preferably the bore selector rotates in a direction substantially parallel with the monobore riser to vary the communication between the monobore risers and either the main bore or the annulus of the duel bore well.

A further aspect of the present invention provides An apparatus for coupling a monobore riser or lubricator system to a dual bore subsea well, said apparatus including a rotatable bore selector, the bore selector including at least one conduit to provide through bore communication between a riser bore and selectively at least one or other of main and annulus bores in the dual bore well, wherein the bore selector in a first position connects the conduit between the riser or lubricator bore and the main bore, and in a second position connects the conduit between the riser or lubricator bore and the annulus bore. Advantageously the bore selector may have a rotation axis offset or set at an angle $\alpha$ to a longitudinal axis of the riser or lubricator bore.

Preferably the axis of rotation is ±5 degrees offset or at an angle to the longitudinal axis, and more preferably ±2.5 to ±3 degrees.

Preferably the axis of rotation of the bore selector extends across a central longitudinal axis of the riser conduit.

Preferably the bore selector conduit has an upper opening remaining inline with a lower opening of the riser or lubricator bore when the bore selector is rotated between first and second positions.

Advantageously the bore selector angle or offset provides increased access to the dual bores from a monobore by allowing a straighter path from the larger main bore whilst still providing sufficient bore offset to communicate with annulus.

A further aspect of the present invention provides an apparatus for coupling a monobore riser or lubricator system to a dual bore subsea well, said apparatus including a rotatable bore selector, the bore selector including a flushing port that can be directed to either the main bore or the annulus bore.

Preferably the flushing port may not be sealed specifically to either main or annulus bore.

DESCRIPTION OF PREFERRED EMBODIMENT

Figure 1:
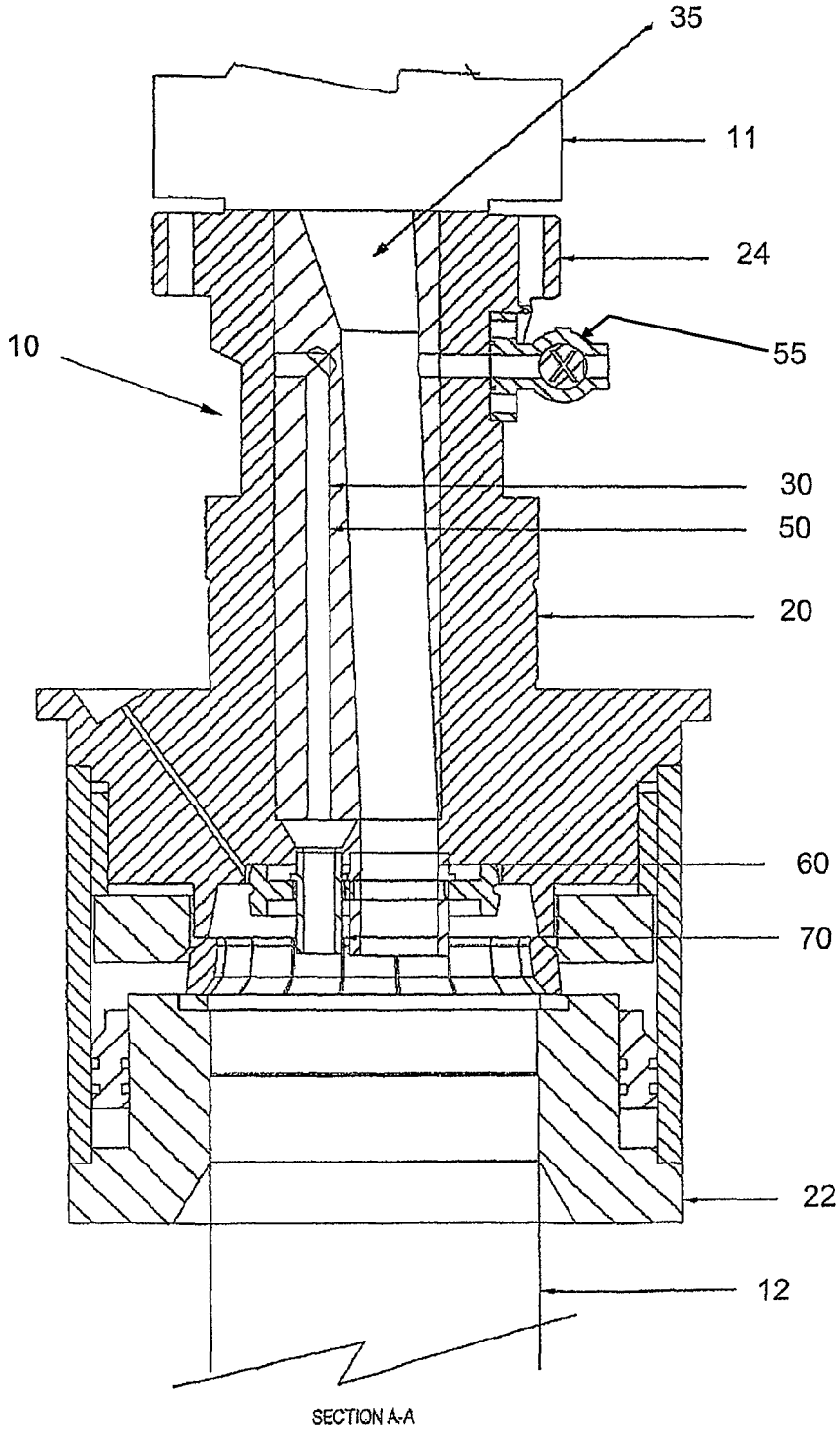
FIG. 1 shows a sectional view of a bore selector of an apparatus according to an embodiment of the present invention to connect a riser or lubricator to the main bore.

It will now be convenient to describe the present invention with respect to the figures. Referring now to FIG. 1 showing a cross section of the coupling/bore selector 10.

The coupling/bore selector 10 is a piece of equipment that is intended to fit between a subsea "Christmas tree" mandrel 12 and adjoining equipment such as a monobore riser or lubricator 11. The couplings bore selector 10 is designed to provide a selectable passage between the adjoining equipment and the subsea Christmas tree. This tool is intended to allow for communication between the adjoining equipment and the main bore and selectively between the adjoining equipment and the annulus bore of the subsea well.

The coupling/bore selector consists of a bore selector housing 20 having a first end 22 adapted to couple to the subsea Christmas tree and a second end 24 adapted to couple to the adjoining equipment. The bore selector housing 20 acts as the body to which the other parts are fitted.

Within the bore selector housing 20 there is an inner rotatable bore selector 30. The bore selector 30 is rotatable around an axis that is substantially collinear with the bore selector housing 20. The bore selector has a passage 35 passing through the core of the bore selector 30. The passage 35 is designed so that the passage 35 is skewed relative to the bore selector so that when the bore selector 30 is in a first position, the passage 35 aligns between the monobore riser and the main bore. When the bore selector 30 is in the second position, the passage 35 aligns between the monobore riser and the annulus of the dual bore subsea well.

The bore selector 30 is actuated by an actuating means that rotate the bore selector 30 for a first position to a second position. The actuating means can be any suitable means but in a preferred embodiment is hydraulic suitable for offshore engineering and extreme pressures associated therewith. The actuating means may be operated by control lines running form the vessel to the actuating means or by a ROV.

The apparatus also has a flush line 50 incorporated. The flushing line 55 is incorporated into the bore selector 30 running substantially parallel to the passage 35 When the bore selector 30 moves so does the flushing line 55. The flush line 50 is arranged such that when the bore selector 30 is in the first position and the passage 35 is aligned between the monobore riser or lubricator and the main bore, the flushing port valve 55 also aligns with the flushing line 50 and the flushing line 50 is in alignment with the annulus. When the bore selector 30 is rotated to its second position such that the passage 30 is aligned with the annulus the flush line 55 is closed off to prevent the flow of fluids from the well.

Depending on the valve arrangements incorporated within the underwater infrastructure and or tooling, when the bore selector 30 is in the first position a fluid path can be established between the annulus and the main bore. This flush line can be used to flush the well and/or the subsea distribution system that is being employed.

The flushing port valve 55 may be connected to a range of equipment such as subsea gate valves and well kill system.

Figure 2:
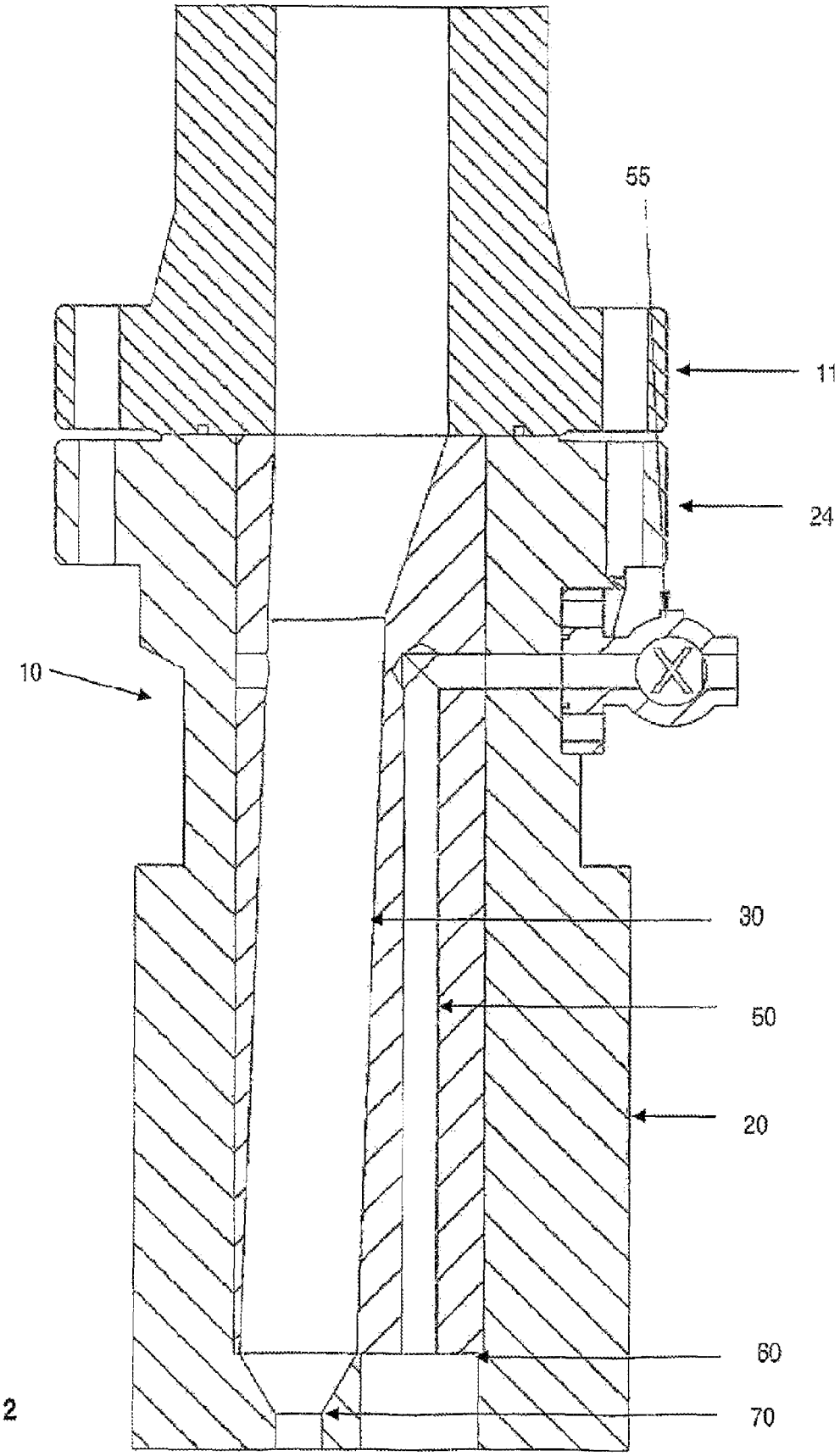
FIG. 2 shows a cross sectional view consistent with FIG. 1 with the bore selector rotated such that a riser or lubricator is connected to the annulus bore. Consequently, the main bore may preferably be connected for flushing

FIG. 2 shows an alternative arrangement of that shown in FIG. 1, though with a different lower mounting arrangement.

Figure 3:
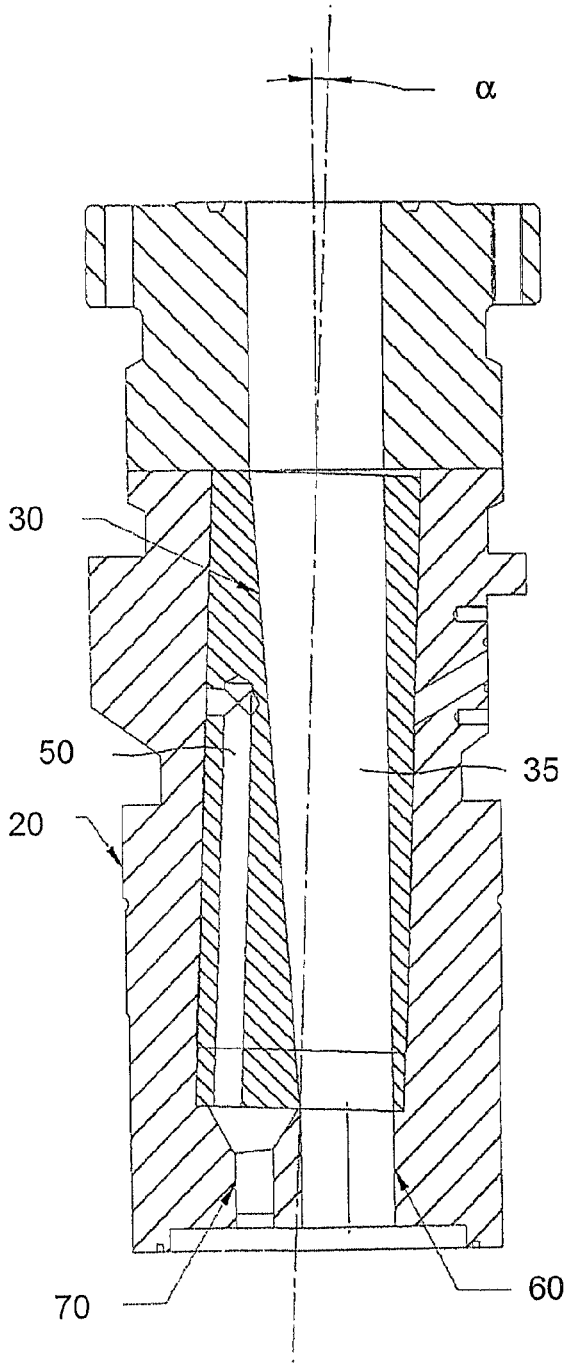
FIG. 3 shows an alternative embodiment including a bore selector with rotation axis tilted with respect to the central axis of the riser.
Figure 4:
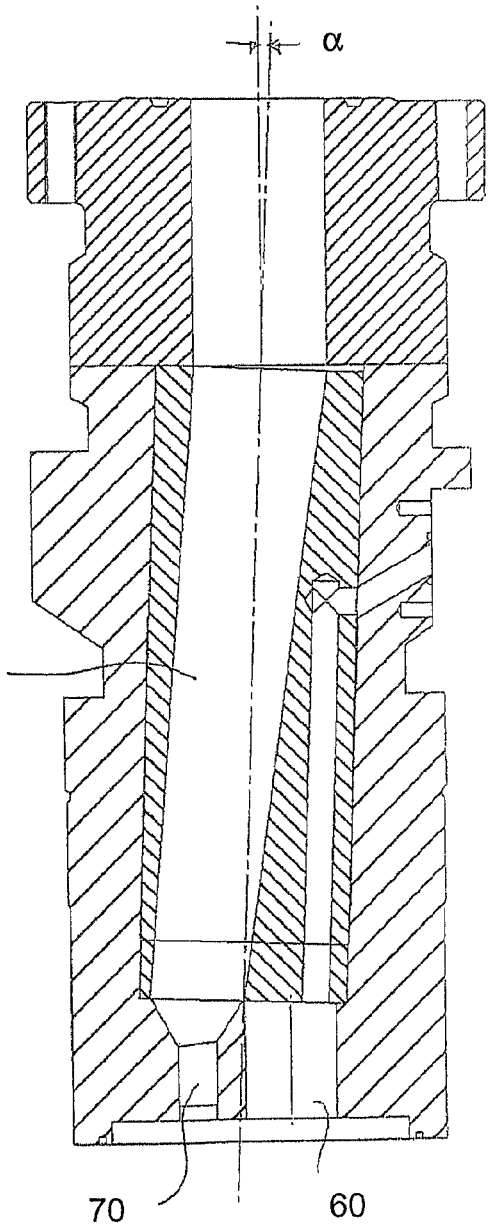
FIG. 4 shows an alternative view of the embodiment shown in FIG. 3 with the bore selector rotated such that the riser or lubricator bores and annulus bores are connected.

FIG. 3 shows an alternative embodiment of the present invention, with the bore selector (spool) mounted with a rotation axis tilted with respect to the central axis of the riser or lubricator bore. In FIG. 1 the conduit through the bore selector connects the riser bore with the main bore 60. In FIG. 4, the bore selector is rotated about the rotation axis to connect the riser and annulus 70 bores. The main bore is shown preferentially connected for flushing via a flushing port in the selector body. The tilt angle $\alpha$ in this example is set at approximately between 2.5 to 3 degrees, though other tilt angles $\alpha$ may be chosen for particular applications.

It would be appreciated that the embodiment describe may be modified and still fall within the scope of the present invention. For example it would be understood that such a device could be adapted to be used with main bores and annuluses of varying sizes. It will also be understood that the method of actuating the bore selector could be achieved in a variety of ways.

The invention claimed is:

1. An apparatus for coupling a monobore riser or a lubricator system having a lubricator bore to a dual bore subsea well having main and annulus bores, said apparatus including a rotatable bore selector within a housing, and a means for actuating the bore selector, wherein the bore selector is rotatably actuatable to provide throughbore fluid communication through a conduit selectively connecting the monobore riser or lubricator system and either of the main or annulus bores in the dual bore subsea well, the main bore being of greater diameter than the annulus bore, and wherein the bore selector has a rotation axis that is extending longitudinally across a longitudinal axis of the monobore riser or lubricator bore, the bore selector is rotated about said rotation axis to selectively connect the monobore riser or lubricator system and either of the bores in the dual bore subsea well, said rotation axis being set at an angle $\alpha$ to the longitudinal axis of the monobore riser or lubricator bore.

2. An apparatus as claimed in claim 1, wherein the bore selector in a first position connects the conduit between the riser or lubricator bore and the main bore, and in a second position connects the conduit between the riser or lubricator bore and the annulus bore.

3. An apparatus as claimed in claim 2, wherein the rotation axis is offset or set at the angle $\alpha$ of ±5° to the longitudinal axis of the riser or lubricator bore.

4. An apparatus as claimed in claim 3, wherein the rotation axis is offset or set at the angle $\alpha$ of between ±2.5° to ±3° to the longitudinal axis of the riser or lubricator bore.

5. An apparatus as claimed in claim 2, wherein the rotatable bore selector further includes at least one flushing line such that the at least one flushing line rotates with the bore selector.

6. An apparatus as claimed in 5, wherein the at least one flushing line runs substantially parallel to the conduit in the bore selector.

7. An apparatus as claimed in claim 5, wherein the at least one flushing line is arranged such that when the bore selector is rotated to a first position with the conduit communicating the monobore riser or lubricator system with a main bore of the dual bores, the flushing line has an opening aligned with an annulus bore of the dual bores, and wherein when the bore selector is rotated to a second position with the monobore riser or lubricator system aligned with the annulus bore, the at least one flushing line is closed off from fluid communication with the main or annulus bores.

8. An apparatus as claimed in claim 7, wherein when the bore selector is in the first position, a fluid path is established between the annulus and main bore.

9. An apparatus as claimed in claim 7, wherein the conduit reduces in cross section from an upper wider end to a narrower lower end.

10. An apparatus as claimed in claim 2, wherein the conduit reduces in cross section from an upper wider end to a narrower lower end.

11. An apparatus as claimed in claim 1, wherein the rotation axis is offset or set at the angle $\alpha$ of ±5° to the longitudinal axis of the riser or lubricator bore.

12. An apparatus as claimed in claim 11, wherein the rotation axis is offset or set at the angle $\alpha$ of between ±2.5° to ±3° to the longitudinal axis of the riser or lubricator bore.

13. An apparatus as claimed in claim 1, wherein the rotatable bore selector further includes at least one flushing line such that the at least one flushing line rotates with the bore selector.

14. An apparatus as claimed in 13, wherein the at least one flushing line runs substantially parallel to the conduit in the bore selector.

15. An apparatus as claimed in claim 13, wherein the at least one flushing line is arranged such that when the bore selector is rotated to a first position with the conduit communicating the monobore riser or lubricator system with a main bore of the dual bores, the flushing line has an opening aligned with an annulus bore of the dual bores, and wherein when the bore selector is rotated to a second position with the monobore riser or lubricator system aligned with the annulus bore, the at least one flushing line is closed off from fluid communication with the main or annulus bores.

16. An apparatus as claimed in claim 15, wherein when the bore selector is in the first position, a fluid path is established between the annulus and main bore.

17. An apparatus as claimed in claim 15, wherein the conduit reduces in cross section from an upper wider end to a narrower lower end.

18. An apparatus as claimed in claim 1, wherein the conduit reduces in cross section from an upper wider end to a narrower lower end.

* * * * *